US008240952B2

(12) United States Patent
Loeb et al.

(10) Patent No.: US 8,240,952 B2
(45) **Date of Patent: *Aug. 14, 2012**

(54) UNIVERSAL PUMP PLATFORM

(75) Inventors: James Bradley Loeb, Cypress, TX (US); Kurt S. Myers, Houston, TX (US)

(73) Assignee: Trident Subsea Technologies, LLC, Houston, TX (US)

( * ) Notice: Subject to any disclaimer, the term of this patent is extended or adjusted under 35 U.S.C. 154(b) by 493 days.

This patent is subject to a terminal disclaimer.

(21) Appl. No.: 12/119,763

(22) Filed: May 13, 2008

(65) Prior Publication Data

US 2008/0282776 A1 Nov. 20, 2008

Related U.S. Application Data

(60) Provisional application No. 60/930,611, filed on May 17, 2007.

(51) Int. Cl.
*B63B 35/00* (2006.01)

(52) U.S. Cl. ..... 405/154.1

(58) Field of Classification Search ..... 73/49.1, 73/49.5; 166/336, 337; 405/154.1
See application file for complete search history.

(56) References Cited

U.S. PATENT DOCUMENTS

| | | | |
|---|---|---|---|
| 3,466,001 | A | 9/1969 | Nelson |
| 3,520,358 | A | 7/1970 | Brooks et al. |
| 3,640,299 | A | 2/1972 | Nelson |
| 3,691,493 | A | 9/1972 | Boysen et al. |
| 3,708,990 | A | 1/1973 | Crooke |
| 3,777,499 | A | 12/1973 | Matthews, Jr. |
| 3,788,084 | A | 1/1974 | Matthew, Jr. |
| 3,961,493 | A | 6/1976 | Nolan, Jr. et al. |
| 4,155,669 | A | 5/1979 | Rochelle |
| 4,165,571 | A | 8/1979 | Chang et al. |
| 4,229,121 | A | 10/1980 | Brown |
| 4,234,268 | A | 11/1980 | Scodino |
| 4,332,277 | A | 6/1982 | Adkins et al. |
| 4,344,319 | A | 8/1982 | Hancock et al. |
| 4,445,804 | A | 5/1984 | Abdallah et al. |
| 4,463,597 | A | 8/1984 | Pierce et al. |
| 4,615,571 | A | 10/1986 | Swank |
| 4,906,136 | A | 3/1990 | Norbom et al. |

(Continued)

FOREIGN PATENT DOCUMENTS

GB 2195739 4/1998

(Continued)

OTHER PUBLICATIONS

Graves Syd. "Vessel-Free Flooding of Deepwater Pipelines Using the Copipe SPU"; The Deepwater Pipeline Technology Conference, New Orleans, LA; Mar. 9-11, 1988 (pp. 15).

(Continued)

*Primary Examiner* — John Fitzgerald
(74) *Attorney, Agent, or Firm* — Conley Rose, P.C.

(57) ABSTRACT

The present invention is directed to a Universal Pumping Platform (UPP) that comprises a platform containing an electric motor that drives a hydraulic pump for producing high pressure hydraulic fluid and one or more pumps powered by the hydraulic fluid from the hydraulic pump. The pump is selected for the desired commissioning method to be carried out, such as filling, chemical treating, pigging, hydrostatic testing or dewatering the pipeline. The UPP is suspended from a vessel by an umbilical that provides the electric current for the electric motor supported by the UPP.

9 Claims, 6 Drawing Sheets

U.S. PATENT DOCUMENTS

| | | | | |
|---|---|---|---|---|
| 5,044,827 | A | 9/1991 | Gray et al. | |
| 5,192,167 | A | 3/1993 | da Silva et al. | |
| 5,267,616 | A | 12/1993 | Silva et al. | |
| 5,273,376 | A | 12/1993 | Ritter, Jr. | |
| 5,348,451 | A | 9/1994 | Mohn | |
| 5,421,674 | A | 6/1995 | Maloberti et al. | |
| 5,842,816 | A | 12/1998 | Cunningham | |
| 5,883,303 | A | 3/1999 | Bliss et al. | |
| 5,927,901 | A | 7/1999 | Graves | |
| 5,975,803 | A | 11/1999 | Mackinnon | |
| 6,022,421 | A | 2/2000 | Bath et al. | |
| 6,109,829 | A | 8/2000 | Cruickshank | |
| 6,145,223 | A | 11/2000 | Flesen | |
| 6,170,493 | B1 | 1/2001 | Sivacoe | |
| 6,171,025 | B1 * | 1/2001 | Langner et al. | 405/154.1 |
| 6,200,068 | B1 | 3/2001 | Bath et al. | |
| 6,234,717 | B1 | 5/2001 | Corbetta | |
| 6,257,162 | B1 * | 7/2001 | Watt et al. | 114/244 |
| 6,290,431 | B1 | 9/2001 | Exley et al. | |
| 6,336,238 | B1 | 1/2002 | Tarlton | |
| 6,435,279 | B1 | 8/2002 | Howe et al. | |
| 6,454,492 | B1 | 9/2002 | Dean et al. | |
| 6,503,021 | B2 | 1/2003 | Corbetta | |
| 6,539,778 | B2 | 4/2003 | Tucker et al. | |
| 6,549,857 | B2 | 4/2003 | Fierro et al. | |
| 6,596,089 | B2 | 7/2003 | Smith et al. | |
| 6,763,889 | B2 | 7/2004 | Rytlewski et al. | |
| 6,840,088 | B2 | 1/2005 | Tucker et al. | |
| 7,011,152 | B2 | 3/2006 | Soelvik | |
| 7,093,661 | B2 | 8/2006 | Olsen | |
| 7,281,880 | B2 | 10/2007 | Tucker et al. | |
| 7,708,839 | B2 * | 5/2010 | Yemington | 134/22.11 |
| 7,765,725 | B2 * | 8/2010 | Jacobsen et al. | 37/317 |
| 2002/0040782 | A1 | 4/2002 | Rytlewski et al. | |
| 2002/0040872 | A1 | 4/2002 | Bogoev et al. | |
| 2002/0059687 | A1 | 5/2002 | Smith et al. | |
| 2002/0059887 | A1 | 5/2002 | Marshall et al. | |
| 2002/0129641 | A1 * | 9/2002 | Tucker et al. | 73/49.5 |
| 2003/0010094 | A1 * | 1/2003 | Tucker et al. | 73/49.5 |
| 2003/0075335 | A1 * | 4/2003 | Amin et al. | 166/350 |
| 2003/0145991 | A1 | 8/2003 | Olsen | |
| 2003/0154769 | A1 | 8/2003 | Tucker et al. | |
| 2003/0170077 | A1 | 9/2003 | Herd et al. | |
| 2007/0003371 | A1 | 1/2007 | Yemington | |
| 2008/0282777 | A1 * | 11/2008 | Loeb | 73/49.5 |
| 2009/0288836 | A1 * | 11/2009 | Goodall et al. | 166/336 |
| 2010/0085064 | A1 * | 4/2010 | Loeb et al. | 324/537 |
| 2010/0089126 | A1 * | 4/2010 | Sweeney | 73/40 |

FOREIGN PATENT DOCUMENTS

| | | |
|---|---|---|
| GB | 2421530 | 6/2006 |
| JP | 226185 | 8/1994 |
| WO | 02084160 | 10/2002 |
| WO | 02088658 | 11/2002 |

OTHER PUBLICATIONS

Graves, Les; "Deepwater Pipeline Flooding and Pigging Without Connection to a Surface Vessel"; Transactions-Institute of marine Engineers, Seriec C, 1999, vol. 111, Nr. 1, (pp. 151-160).

Graves, Les, "Controlled Deepwater Pipeline Flooding & Pigging Without Connection to a Surface Vessel"; Pipeline & Gas Journal; Aug. 2001; (pp. 2).

Engelmann, Georg; Dupre, Mike. "Development and Utilization of an all Subsea, ROV Based, Flowline Pre-Commissioning System" Offshore Technology Conference OTC 15146; May 2003; (pp. 5).

Furlow, William; "Smaller, Shallow Tieback Market Grown"; Offshore Magazine, Subsea/Surface Systems, Dec. 2003; [online] Retrieved from the Internet on Jun. 22, 2009; <URL: http://www.offshore-mag.c; (pp. 5).

Ghiselin, Dick; "Wunderbar!"; E&P Magazine; Feb. 1, 2004 [online] Retrieved from the Internet on Jun. 22, 2009; <URL: http://www.epmag.com/ar; (pp. 2).

Frontier 300 Subsea Flooding Unit; Weatherford, Subsea Tieback Conference Forum, Galveston, Texas; Mar. 2005; (pp. 2).

Proposal relating to Pipeline Service Solutions to Independence Hub Integrated Project Team; Jun. 2005; (see p. 5); (pp. 14).

Pipeline & Specialty Services; Weatherford; Presented at SGA Offshore, LA; Aug. 2005; (pp. 44).

International Search Report and Written Opinion Dated Aug. 28, 2008 for Appl. No. PCT/US2008/063599 (10 p.).

Rigzone—Planning and Problem Solving in the Offshore Environment, May 21, 2003 (http://www.rigzone.com/news/article.asp?a_id=673) (8 pp).

U.S. Office Action dated Apr. 4, 2011, U.S. Appl. No. 12/119,782.

* cited by examiner

UNIVERSAL PUMP PLATFORM

CROSS-REFERENCE TO RELATED APPLICATIONS

The present application claims the benefit of 35 U.S.C. 111(b) provisional Application Ser. No. 60/930,611 filed May 17, 2007, and entitled "Universal Pumping Platform". A related application of James B. Loeb, filed concurrently with this application, titled "Geometric Universal Pump Platform" is incorporated herein by reference.

STATEMENT REGARDING FEDERALLY SPONSORED RESEARCH OR DEVELOPMENT

Not applicable.

FIELD OF THE INVENTION

The present invention is directed to a universal pump platform (UPP) commissioning system for deep water pipelines. More specifically, the UPP comprises a platform containing an electric motor that drives a hydraulic pump for producing high pressure hydraulic fluid and one or more pumps powered by the hydraulic fluid from the hydraulic pump. The pump(s) is selected for cleaning, filling, chemical treating, pigging, hydrostatic testing or dewatering the pipeline. The UPP is suspended from a vessel by an umbilical that provides the electric current for the electric motor.

BACKGROUND OF THE INVENTION

U.S. Pat. Nos. 6,539,778; 6,840,088; and U.S. Pat. No. 7,281,880 are directed to pumping skids that are connected to a subsea vehicle (SV) to carry out pipeline commissioning methods. By their design, the pumping skids are attached to the underside of the SV and require the SV to power the pumps on the skid. When commissioning a pipeline, the skid and SV act as a single unit.

The present invention employs an independent Universal Pumping Platform that has its own power supply provided by an umbilical from a vessel to an electric motor that drives a hydraulic pump for producing high pressure hydraulic fluid. This hydraulic fluid is then used to power one or more pumps depending on the specific commissioning operation. The UPP is independent, structurally or for a source of power, of any SV or ROV used in the commissioning operations.

SUMMARY OF THE INVENTION

The present invention is directed to a Universal Pumping Platform (UPP) that comprises a platform containing an electric motor that drives a hydraulic pump for producing high pressure hydraulic fluid and one or more pumps powered by the hydraulic fluid from the hydraulic pump. The pump is selected for the desired commissioning method to be carried out, such as hydrostatic testing or dewatering the pipeline. The UPP is suspended from a vessel by an umbilical that provides the electric current for the electric motor supported by the UPP.

BRIEF DESCRIPTION OF THE PREFERRED EMBODIMENTS OF THE PRESENT INVENTION

Subsea pipelines are utilized to transport the discovered product from wells drilled subsea to a variety of disposition points. These points include existing or new offshore platforms, new pipelines or old pipelines, all of which are transporting the hydrocarbon products to onshore facilities. The pipelines terminate subsea in manifolds, used herein as a generic term, to include for example, wellhead trees, pipeline end manifolds (PLEMs), and pipeline end terminators (PLETs), to name a few. As new wells are completed, subsea pipelines form a matrix of flow for the oil/gas products that are tied through these manifolds to bring the product to shore. As dictated by law, the new sections of pipeline require hydrostatic testing to make certain that the line has no leaks. In addition to hydrostatic testing, other steps in the commissioning of the pipeline may be required, including flooding, pigging, cleaning, and installing chemicals that prepare the pipeline for hydrostatic testing or dewatering and drying that may follow the successful hydrostatic testing.

Once a well is completed, a pipeline is connected to the production well pipelines for transporting the product to shore. The pipeline commissioned by the present invention often does not extend all the way to shore but is at the outer part of the matrix, a section or segment measured in hundreds or thousand of feet. Also common to a manifold as used herein is that there is structure to provide internal access to the pipeline, with a structure known as a hot stab. The subsea performance or operation of the commissioning methods of the present invention will be described as commissioning a pipeline between two manifolds or PLEMs, or between two hot stab points in the pipeline.

The present invention relates to the commissioning of these subsea pipelines carried out on the pipelines on the seabed by using a Universal Pumping Platform (UPP) that is suspended by an umbilical from a vessel. An umbilical is a composite cable. The function of the cable is multipurpose in that it provides (1) electric current from the vessel to the platform, for the hydraulic pump(s) and possibly lights, instrumentation, or other functions; (2) data transmission; (3) strength for supporting the platform at the tethered position or depth.

Figure 1:
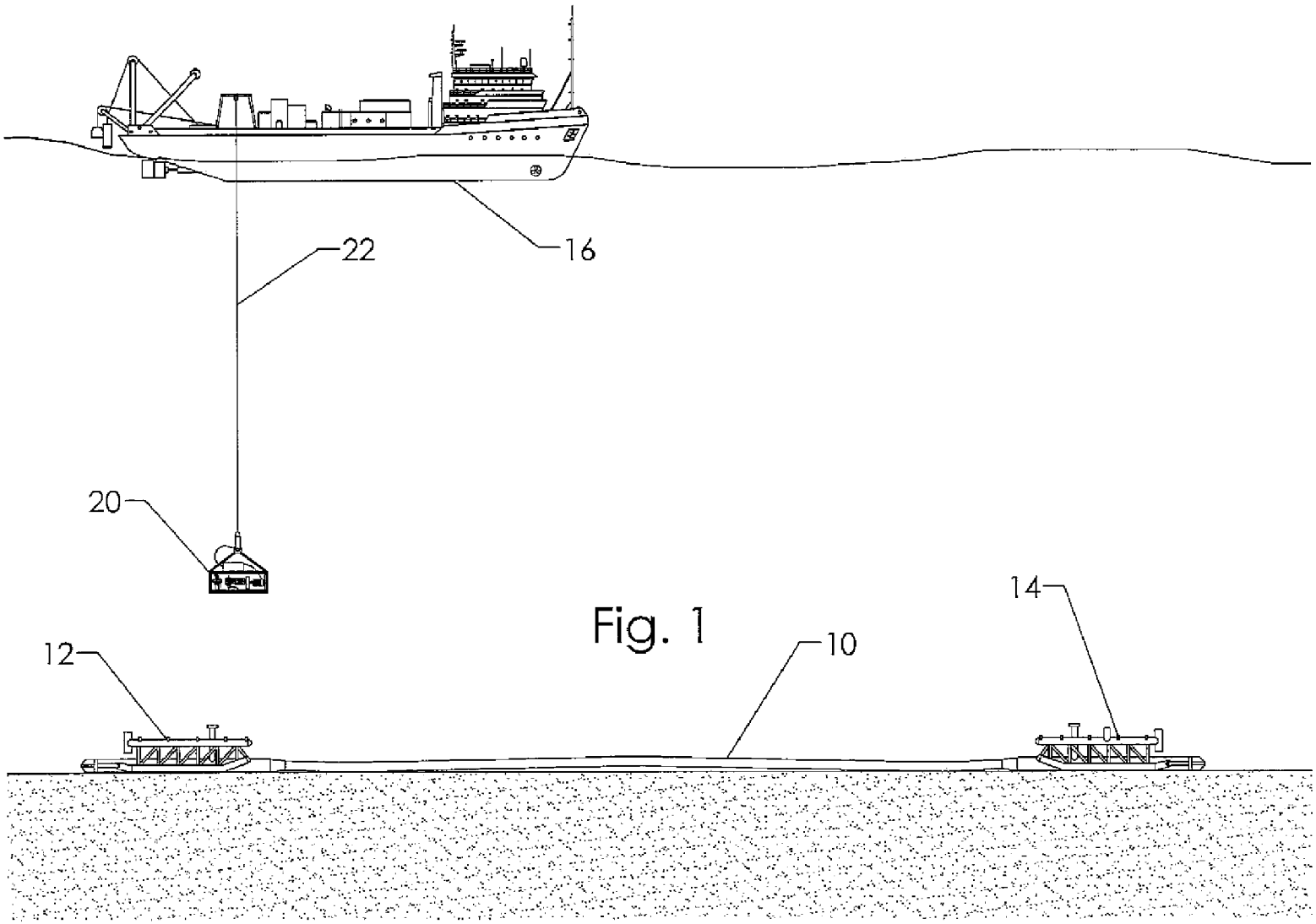
FIG. 1 is a schematic view of a pipeline that is to be commissioned that has at least one hot stab to access the pipeline and a Universal Pump Platform (UPP) of the present invention suspended from a vessel to carry out a commissioning method on the deep water pipeline.

Referring to FIG. 1, a deep water pipeline 10 lies on or near the sea floor between a PLEM 12 and a second PLEM 14. The pipeline 10 may be a new line or an old line that requires a commissioning method of the present invention. If newly laid, the pipe may have the PLEM 12 connected to the pipe as it comes off the pipe laying vessel and this structure is lowered to the subsea floor. The PLEM 14 on the other end of the pipe may be lowered to the subsea floor to complete the pipeline. A new pipeline usually has air in the line and requires a flooding commissioning method prior to hydrostatic testing while an old line has water already in the line. A vessel 16 is positioned above pipeline 10 and a UPP 20 is launched over the side of the vessel 16 and lowered in the near vicinity of PLEM 12 to carry out one of the commissioning methods of the present invention.

A Universal Pumping Platform (UPP) 20 comprises a non-buoyant structure consisting of a metal, preferably aluminum, frame that supports an electric motor that drives a hydraulic pump for producing high pressure hydraulic fluid and one or more pumps powered by the hydraulic fluid for the desired commissioning method of hydrostatic testing or dewatering the pipeline. The UPP is suspended from a vessel by an umbilical 22 that provides the electric current for an electric motor supported by the UPP.

The platform (UPP) is highly flexible in that one or more electric lines may be in the umbilical composite cable. Thus, one or more electric motors may power hydraulic pumps or water pumps. A hydraulic pump on the platform will provide high pressure hydraulic fluid to power a single pump or a plurality of pumps for pumping water suitable to meet the design requirements of the specific commissioning method at the depth pressures and pipe sizes of a specific subsea pipeline. The requirements for hydrostatic testing, for example, is a single pump, or a plurality of pumps, for pumping seawater at high pressure into a pipeline to increase the internal pressure to hydrostatic testing requirements (see API RP 1110; API RP 1111; ASME B31.4-2002; ASME B 31.8-2003; approximately 1.25×m. o. p. of the pipeline).

In addition, the platform may have a data transmitting or collecting interface. Examples are data lines connected to pipeline water pressure and/or temperature devices; and electronic devices for measuring whether stabs of lines for water flow or data are connected securely, and feedback on the status of platform equipment. Flow rates or volume of water pumped may also be measured and the data transmitted through the umbilical to the vessel. Pigs passed through the pipeline during a pigging commissioning method may be detected or measured, either the launching of a pig into the pipeline from a pig launcher or the recovery of a pig from the pipeline into a pig receiver. Smart pigs or other electronics may provide information of a pig as it flows through the pipeline, and acoustic data may be transmitted by the pig, received by the platform, and relayed to the surface via the umbilical to the platform.

Advantages of the UPP are:

1) No concern for the weight of the platform (UPP) as opposed to a skid attached to an ROV.
2) No buoyancy foam. Cost savings of $40,000 to $50,000.
3) Unlimited depth range as opposed to the limitations of buoyancy of an ROV.
4) Smaller in physical size with no foam. Deck space is always at a premium on the vessels.
5) Does not have to be uncoupled from the ROV to be worked on. All aspects of platform are immediately accessible.
6) Because it is not connected to the ROV and using its hydraulic HP (hydraulic pump), the platform can be easily used on ships with older ROV equipment of lesser horsepower.
7) Standing alone the platform can be configured into many sizes and shapes and weights whereas all ROVs have limits to how much weight can be attached to them.

Specific embodiments of the present invention are set forth in the drawings and description hereinafter.

Figure 2:
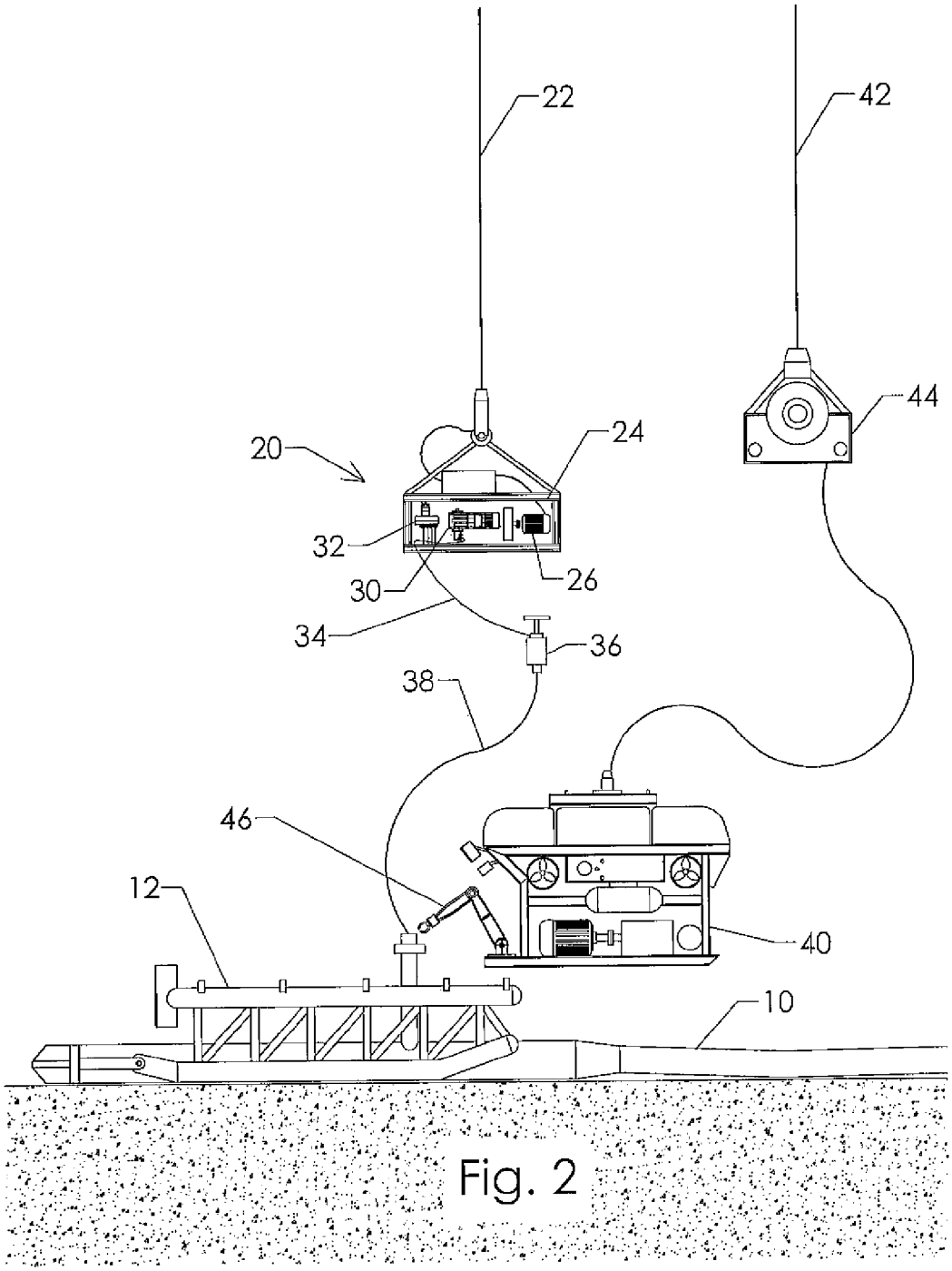
FIG. 2 is a schematic view of a UPP having a high pressure pump on the UPP with a line having a stab to be connected to a hot stab on the pipeline by a Remote Operated Vehicle (ROV) to carry out a hydrostatic test commissioning method on the deep water pipeline.

Referring now to FIG. 2, a UPP 20 is lowered by an umbilical 22 above and in the vicinity of PLEM 12. This UPP 20 is designed specifically for hydrostatic testing and characterized by an aluminum frame 24. The frame supports a power assembly that is connected to the umbilical 22; specifically, an electric motor 26 powers a hydraulic motor that provides high pressure hydraulic fluid for powering the pumps carried by frame 24; specifically, a high pressure triplex reciprocating pump 30 that pumps seawater into the pipeline 10 for hydrostatic testing of the pipeline. Preferably, the frame structure 24 also carries one or more chemical pump(s) 32. A line 34 transfers the high pressure water and chemicals through a break-away device 36 and a line 38 having a stab for connecting to an opening in PLEM 12. A remote operating vehicle (ROV) 40 is used to stab line 38 into PLEM 12.

The ROV has its own umbilical 42 which is shown connected to a tether management system (TMS) 44. The ROV's gripper 46 is manipulated to open and shut valves on the UPP's pumps to perform the operational procedures for the commissioning method.

Figure 3:
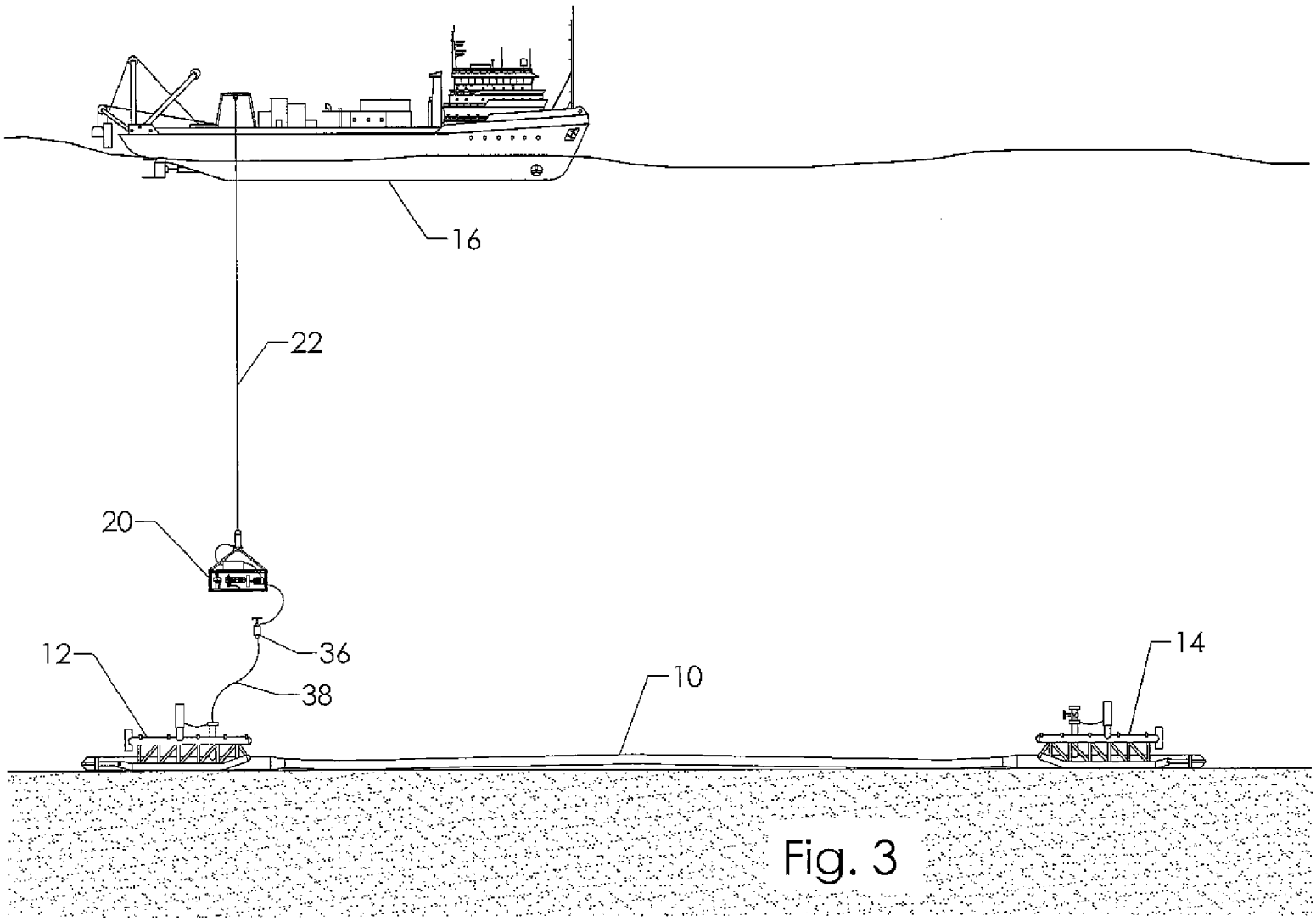
FIG. 3 is a schematic view of the UPP operating completely from a vessel.
Figure 4:
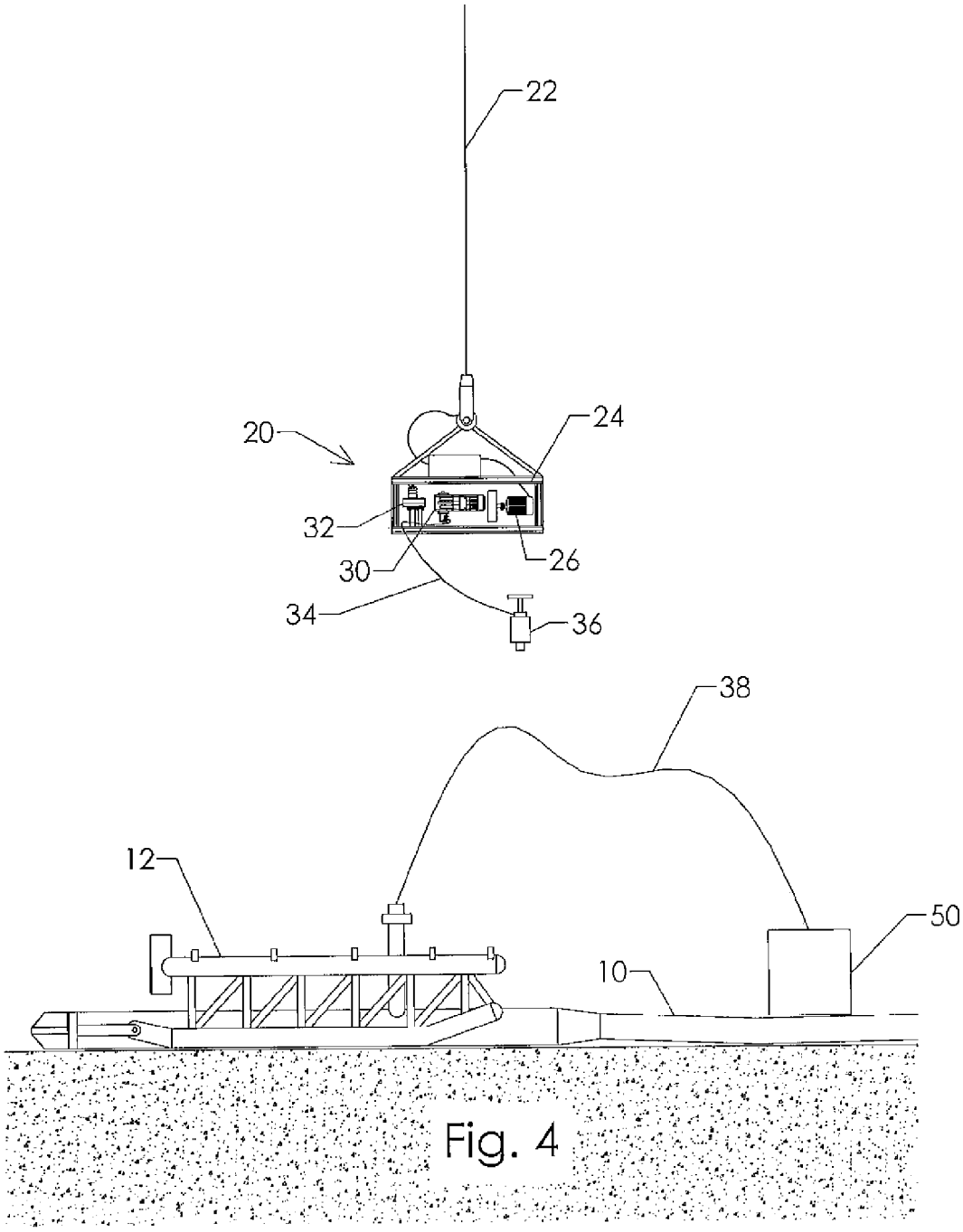
FIG. 4 is a schematic view of relieving the pressure after hydrostatic testing.

Referring now to FIG. 3, the platform herein does not require the interface of a robotic operating vessel (ROV) to power the pumps on the platform. The water pump(s) on the platform herein are directly powered by the hydraulic pump on the UPP. The UPP of the present invention and the ROV are independent. The pumps on the UPP may operate once connected to the pipeline without the ROV; the ROV is free to do other operations when the pumps on the platform are running; and in times of bad weather, the disconnect operations are independent of the ROV. Referring to FIG. 4, once the pressure for hydrostatic testing has been maintained for a sufficient time to pass the hydrostatic test, and prove no leaks, the line 38 is connected to a filter 50 to relieve the pressure in the pipeline and allow the high pressure water to be environmentally treated for release to the sea.

Figure 5:
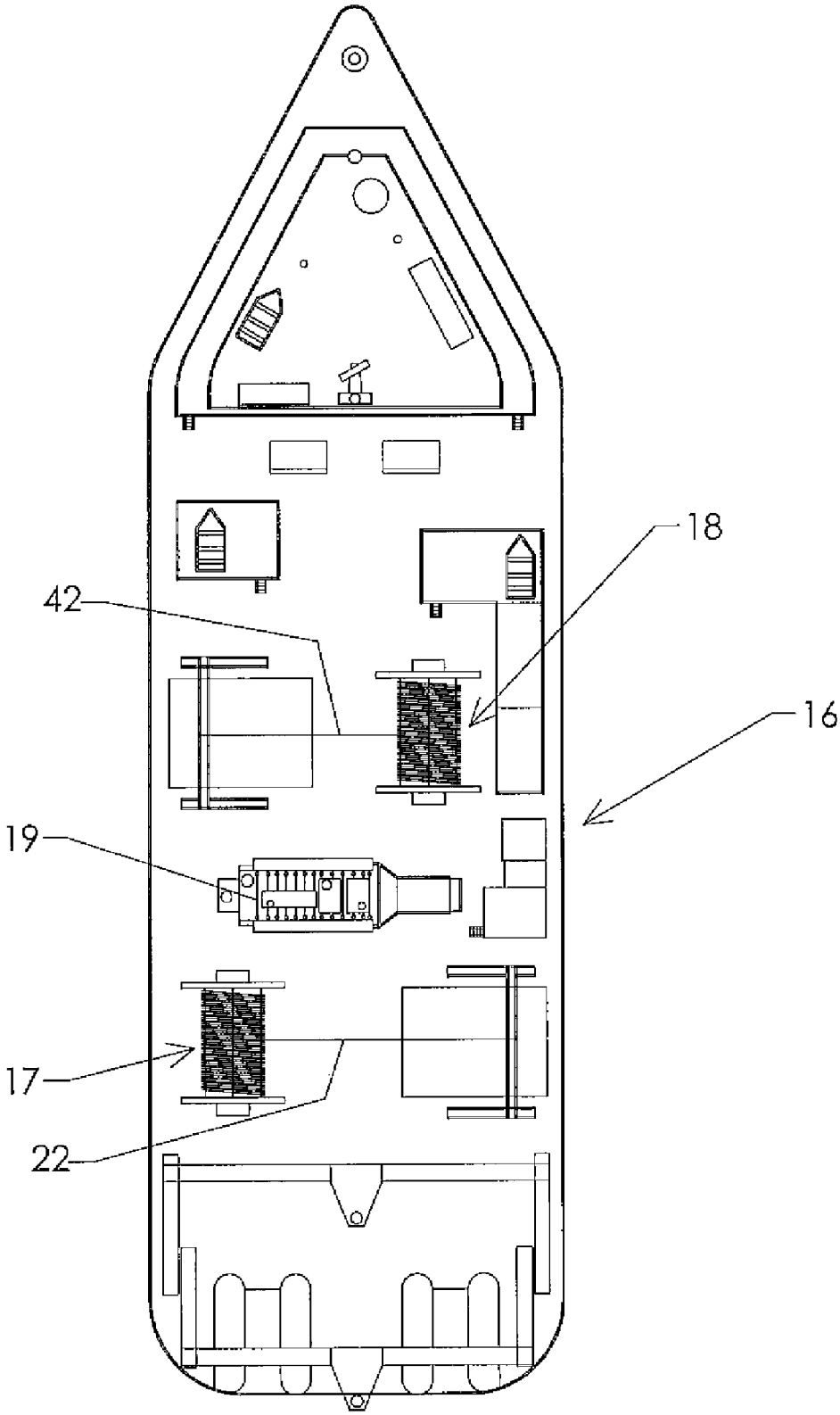
FIG. 5 is a schematic view of a deck of a vessel having the necessary launch and recovery system (LARS) and electric source to deploy the UPP.

In the present embodiment, the UPP and ROV are independently launched and recovered. This reduces the lifting weight requirement of the equipment on the vessel 16. Referring now to FIG. 5, a schematic view of the deck of vessel 16 is shown. At least two launch and recovery systems 17 and 18, are illustrated, one 17 with the umbilical 22 on the winch for launching the UPP 20 and another 18 with the umbilical 42 for launching the ROV. A generator 19 is on deck to generate the electricity to the umbilical 22. The electric generator(s) for the ROV are usually below deck.

Figure 6:
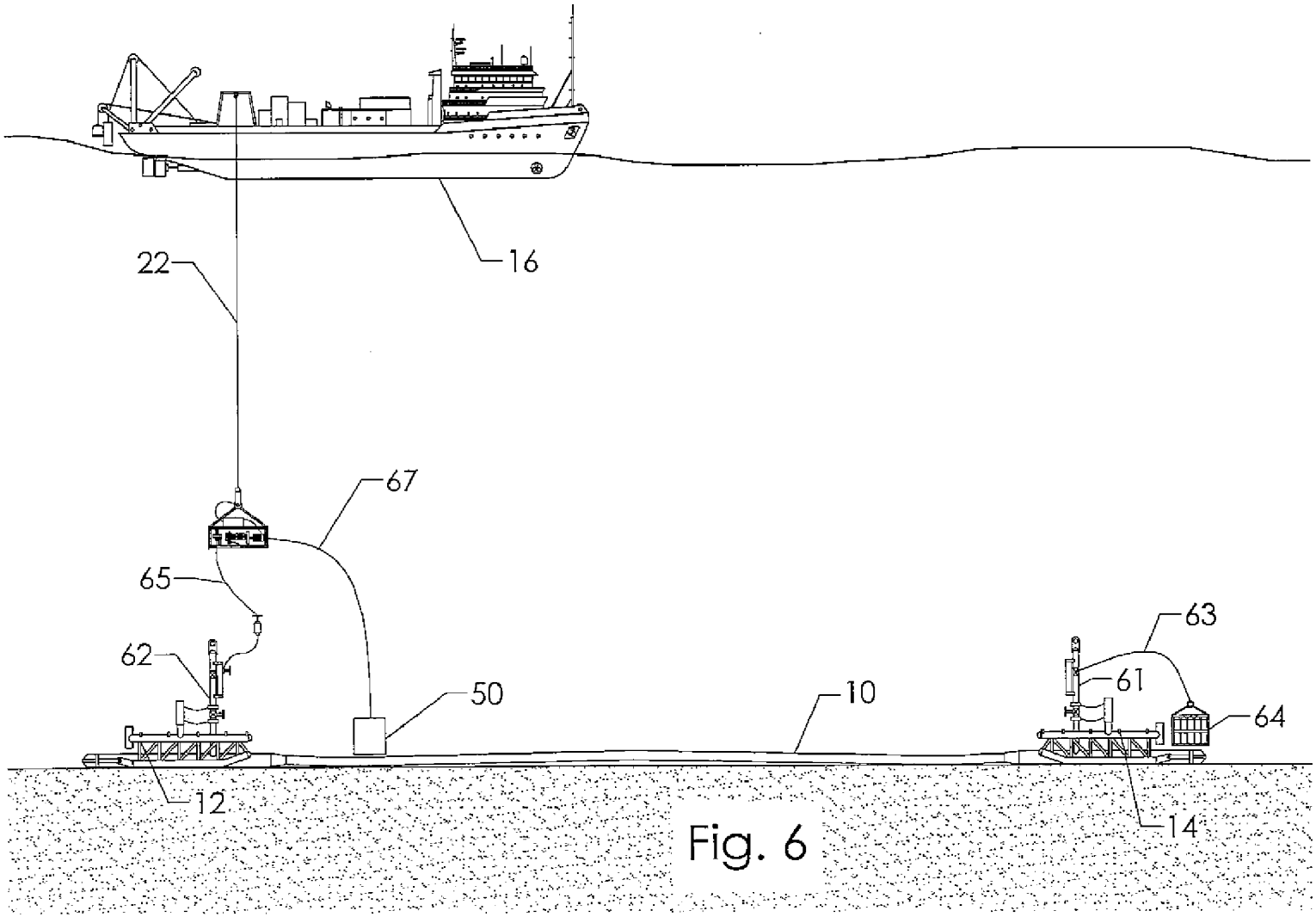
FIG. 6 is a schematic view of a UPP having the reciprocating pump being connected by a Remote Operated Vehicle (ROV) to a pig receiver mounted on a pipe line end manifold (PLEM) to carry out a dewatering commissioning method on the deep water pipeline.

Another embodiment of the present invention is illustrated in FIG. 6, wherein the pipeline 10 has a PLEM 12 at one end and a PLEM 14 at the other end, each PLEM has a pig launcher/receiver 61 and 62 attached to the respective PLEM. At the one end, a quantity of high pressure gas containers 64 are placed on or near the PLEM 14 and pig launcher 61 and a line 63 connects the gas containers 64 to the pig launcher 61. At the other end, an ROV 40 has connected by line 65 a pump on a UPP 20, but not necessarily the same as UPP 20 before, to the pig receiver 62 to pump the water in pipeline 10 out of the pipeline and is by line 67 directing the water through a filter 50 for environmentally disposing the water. The UPP 20 may differ from one another by the choice of the pump, among other considerations, on the UPP 20. Thus, depending upon the specific commissioning procedure, the UPP 20 may be modified for that procedure.

What is claimed is:

1. A commissioning system for deep water pipelines comprising:

a non-buoyant platform suspended from a first umbilical configured to support the weight of the platform and including an electric motor configured to drive a hydraulic pump for pressurizing hydraulic fluid and a pump disposed on the platform, wherein the pump is configured to be powered by said hydraulic fluid; and a remotely operated vehicle independent of the platform and attached to a second umbilical, wherein the remotely operated vehicle is configured to couple the pump to the subsea pipeline;

wherein said pumps is configured to perform a commissioning method selected from the group of filling, chemical treating, pigging, hydrostatic testing and dewatering on a subsea pipeline.

2. A commissioning system according to claim 1 wherein said metal is aluminum.

3. A commissioning system according to claim 1 wherein said pump is a high pressure triplex pump.

4. The commissioning system of claim 1, wherein the platform includes an interface configured to collect and transmit data.

5. A commissioning system according to claim 1 wherein the first umbilical is suspended from a vessel and is configured to provides electric current to said electric motor.

6. The commissioning system of claim 5, wherein the first umbilical is configured to provide a conduit for data transmission between the platform and the vessel.

7. The commissioning system of claim 1, further comprising:

a manifold disposed on the sea floor and coupled to the subsea pipeline;

a conduit connecting the pump to the manifold.

8. The commissioning system of claim 7, wherein the remotely operated vehicle is configured to stab an end of the conduit into the manifold.

9. The commissioning system of claim 7, wherein the conduit comprises a break-away device configured to disconnect the conduit from the manifold.

* * * * *